US008911052B2

(12) United States Patent
Nishimura

(10) Patent No.: US 8,911,052 B2
(45) Date of Patent: Dec. 16, 2014

(54) INKJET RECORDING MACHINE

(71) Applicant: Riso Kagaku Corporation, Tokyo (JP)

(72) Inventor: Asayo Nishimura, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/930,739

(22) Filed: Jun. 28, 2013

(65) Prior Publication Data

US 2014/0028751 A1 Jan. 30, 2014

(30) Foreign Application Priority Data

Jul. 26, 2012 (JP) ..... 2012-165485

(51) Int. Cl.

| | |
|---|---|
| ***B41J 29/38*** | (2006.01) |
| ***B41J 11/00*** | (2006.01) |
| ***B41J 13/00*** | (2006.01) |
| ***B41J 13/22*** | (2006.01) |

(52) U.S. Cl.

CPC ..... *B41J 11/0085* (2013.01); *B41J 13/0009* (2013.01); *B41J 13/226* (2013.01); *B41J 11/007* (2013.01)

USPC ..... 347/16

(58) Field of Classification Search

CPC ..... B41J 13/226; B41J 11/0085

See application file for complete search history.

(56) References Cited

U.S. PATENT DOCUMENTS

2006/0284953 A1* 12/2006 Hatasa et al. ..... 347/105

FOREIGN PATENT DOCUMENTS

| | | |
|---|---|---|
| JP | 2007-136847 A | 6/2007 |
| JP | 2010-105208 A | 5/2010 |

* cited by examiner

*Primary Examiner* — Julian Huffman

(74) *Attorney, Agent, or Firm* — Nath, Goldberg & Meyer; Jerald L. Meyer; Leonid D. Thenor

(57) ABSTRACT

A control unit is configured to form a print image on a recording medium by ejecting ink drops from nozzles of an ink head to the recording medium being conveyed on a conveyance route and sucked to the conveyance route by a negative pressure generated by a suction unit. The control unit is configured to control a level of suction power of sucking the recording medium to the conveyance route by the negative pressure in accordance with a level of a resolution of the print image in at least one of a main scanning direction or a sub scanning direction.

3 Claims, 8 Drawing Sheets

INKJET RECORDING MACHINE

CROSS REFERENCE TO RELATED APPLICATION

This application is based upon and claims the benefit of priority from the prior Japanese Patent Application No. 2012-165485, filed on Jul. 26, 2012, the entire contents of which are incorporated herein by reference.

BACKGROUND

1. Technical Field

The present invention relates to an inkjet recording machine configured to eject drops of ink in an ink chamber from a nozzle.

2. Related Art

In an inkjet recording machine, ink in an ink chamber provided at an inkjet head is ejected as a drop from a nozzle. The ink drop ejected from the nozzle flies with a tail, and there are a time lag and a speed difference between a head portion and a tail portion of this drop in flight. Thus, accompanying a preceding main drop, unnecessary minute drops (satellite drops) might be produced. The satellite drops (also called mist) degrade the printing quality by attaching onto a recording medium, and contaminate the device by attaching to the inside of the device.

Such satellite drops are produced in the same way in both a serial-type recording machine and a line-type recording machine. In the serial-type recording machine, an inkjet head on a carriage reciprocates in a main scanning direction which is orthogonal to a conveyance direction of the recording medium. In the line-type recording machine, a line head extending over the entire length in the main scanning direction is formed by arranging multiple head blocks each provided with multiple nozzles.

For example, Japanese Patent Application Publication No. 2007-136847 proposes a technique of forcibly sucking the satellite drops to prevent the satellite drops from flying to, for example, portions other than proper landing positions on a recording medium or to portions of the device around the recording medium.

The satellite drops described above are produced more as the speed of ink ejected from the nozzles is increased in order to maintain the amount of ink ejected under a low temperature which increases the viscosity of the ink. To address this, Japanese Patent Application Publication No. 2010-105208 proposes the following technique for an inkjet recording machine configured to suck a recording medium to a belt platen by use of a negative pressure generated by a suction fan. Specifically, the technique prevents satellite drops from widely diffusing along with the air flow for sucking the recording medium, by reducing the amount of negative pressure generated by the suction fan when the temperature of the ink is low.

SUMMARY

In the inkjet recording machine, the printing quality depends on the dot gain of ink drops landing on a recording medium. For this reason, in some cases, for example a high-definition image is printed with the resolution raised by decreasing the volume of each ink drop and increasing the number of ink drops per unit area landing on the recording medium.

Such printing with the resolution raised is performed for a particular color in an inkjet recording machine capable of color printing or selectively performed for printing an image required to have a high resolution.

As an example of the printing with the resolution raised for a particular color, only a single color K (black) may be raised in resolution in order to, for example, make a text in a print image sharp on its edges. Further, for example, in a case of printing a high-resolution image, the printing is performed with the number of ink drops per unit area landing on the recording medium being increased by, for example, using more nozzles than in a case of printing a regular-resolution image.

In this way, when high-resolution printing is performed selectively for a particular color or for a particular print image, the number of ink drops per unit area landing on the recording medium increases, and consequently the number of satellite drops produced along with the ink drops also increases.

The present invention has an objective of providing an inkjet recording machine capable of preventing degradation in the quality of a printed image and preventing progress of contamination damage of the device due to the satellite drops drifting along an air flow by a negative pressure for sucking a recording medium to a belt platen, when the number of satellite drops produced along with ink drops ejected from nozzles increases due to a factor other than a change in the viscosity of ink.

An inkjet recording machine in accordance with some embodiments includes a conveyance route configured to convey a recording medium in a conveyance direction, a suction unit configured to generate a negative pressure for sucking the recording medium to the conveyance route, an ink head having nozzles configured to eject ink drops, and a control unit configured to form a print image on the recording medium by ejecting ink drops from the nozzles of the ink head to the recording medium being conveyed on the conveyance route and sucked to the conveyance route by the negative pressure generated by the suction unit. The control unit is configured to control a level of suction power of sucking the recording medium to the conveyance route by the negative pressure in accordance with a level of a resolution of the print image in at least one of a main scanning direction orthogonal to the conveyance direction or a sub scanning direction along the conveyance direction.

According to the above configuration, even when the number of satellite drops produced along with ink drops ejected from nozzles changes by performing printing with a resolution selectively changed for a particular color or a particular image, it is possible to prevent satellite drops drifting along an air flow by a negative pressure for sucking a recording medium to a belt platen from degrading the quality of the print image and from advancing contamination damage of the device.

The higher the resolution of a print image in at least one of the main scanning direction which is orthogonal to the conveyance direction of the recording medium and the sub scanning direction which is along the conveyance direction, the larger the number of ink drops per unit area landing on the recording medium. With this, the number of satellite drops produced along with the ink drops increases.

When the power of sucking the recording medium to the conveyance route by use of the negative pressure is reduced, the range in which each satellite drop lands away from its main ink drop after drifting along an air flow for sucking the recording medium is narrowed. When the landing range of the satellite drops is thus narrowed, the satellite drops are less noticeable even if the number of satellite drops landing on a white portion of the recording medium is increased with raising of the resolution. For this reason, by controlling the power of sucking the recording medium to the conveyance route according to the resolution of an image to be printed, it is possible to prevent degradation in the quality of a printed image and to prevent progress of contamination damage of the device.

The ink head may be provided in a plurality for respective colors of ink, the ink head of at least certain one of the colors of ink may be capable of ejecting ink drops with a higher resolution than the ink head of the other color, and the control unit may be configured to drive the ink head of the certain color of ink to eject ink drops with the higher resolution than the ink head of the other color, with the suction power for a first portion of the conveyance route facing the ink head of the certain color of ink more reduced than the suction power for a second portion of the conveyance route facing the ink head of the other color.

According to the above configuration, for a portion of the conveyance route facing the ink head of the certain color of ink which ejects ink drops with a higher resolution than the ink head of the other color of ink, the power of sucking the recording medium to the conveyance route by use of the negative pressure is made lower than that for other portions of the conveyance route.

Thus, the power of sucking the recording medium to the conveyance route by use of a negative pressure is reduced only for the portion of the conveyance route where more satellite drops are produced because of a high resolution and therefore the landing range of the satellite drops separated from its main drop needs to be narrowed. Thereby, the capability of sucking the recording medium to the conveyance route by use of the negative pressure is prevented from being uselessly reduced for the portion of the conveyance route where the resolution is low and therefore no increase in the number of satellite drops occurs.

The control unit may be configured to reduce the suction power for the first portion to be lower than the suction power for the second portion by reducing an amount of the negative pressure for the first portion to be lower than an amount of the negative pressure for the second portion with a total amount of the negative pressure generated by the suction unit for an entire of the conveyance route being constant.

According to the above configuration, for a portion of the conveyance route facing the ink head of the certain color of ink which ejects ink drops with a higher resolution than the ink head of the other color of ink, the power of sucking the recording medium to the conveyance route by use of a negative pressure is made lower than that for other portions of the conveyance route. Consequently, the amount of negative pressure generated by the suction unit is lowered. However, the total amount of negative pressure for the entire conveyance route for sucking the recording medium is maintained to be constant.

For this reason, even if the power of sucking the recording medium to the conveyance route by use of a negative pressure is reduced for the portion of the conveyance route facing the ink head of the certain color of ink which ejects ink drops with a higher resolution than the ink head of the other color of ink, the reduced capability of sucking the recording medium to the conveyance route can be compensated for by increasing the amount of negative pressure generated for the other portions of the conveyance route. Thus, the overall capability of sucking the recording medium to the conveyance route can be maintained to be constant.

The control unit may be configured to print the print image with a resolution above a predetermined value with an amount of the negative pressure generated by the suction unit more reduced than in printing the print image with a resolution at or below the predetermined value.

According to the above configuration, the power of sucking the recording medium to the conveyance route by use of a negative pressure is lower in printing a print image with a resolution above a predetermined value, than in printing a print image with a resolution at or below the predetermined value.

Thus, the power of sucking the recording medium to the conveyance route by use of a negative pressure is reduced only in printing a print image where more satellite drops may be produced because of its high resolution and therefore the landing range of the satellite drops separated from its main drop needs to be narrowed. Thereby, the capability of sucking the recording medium to the conveyance route by use of a negative pressure is prevented from being uselessly reduced when printing a print image with a low resolution which does not suffer an increase in the number of satellite drops produced.

BRIEF DESCRIPTION OF DRAWINGS

FIG. 3A is an explanatory diagram showing ink drops of C, M, or Y ejected with a resolution of 300 dpi in a main scanning direction, and FIG. 3B is an explanatory diagram showing ink drops of K ejected with a resolution of 600 dpi in the main scanning direction.

DETAILED DESCRIPTION

Figure 1:
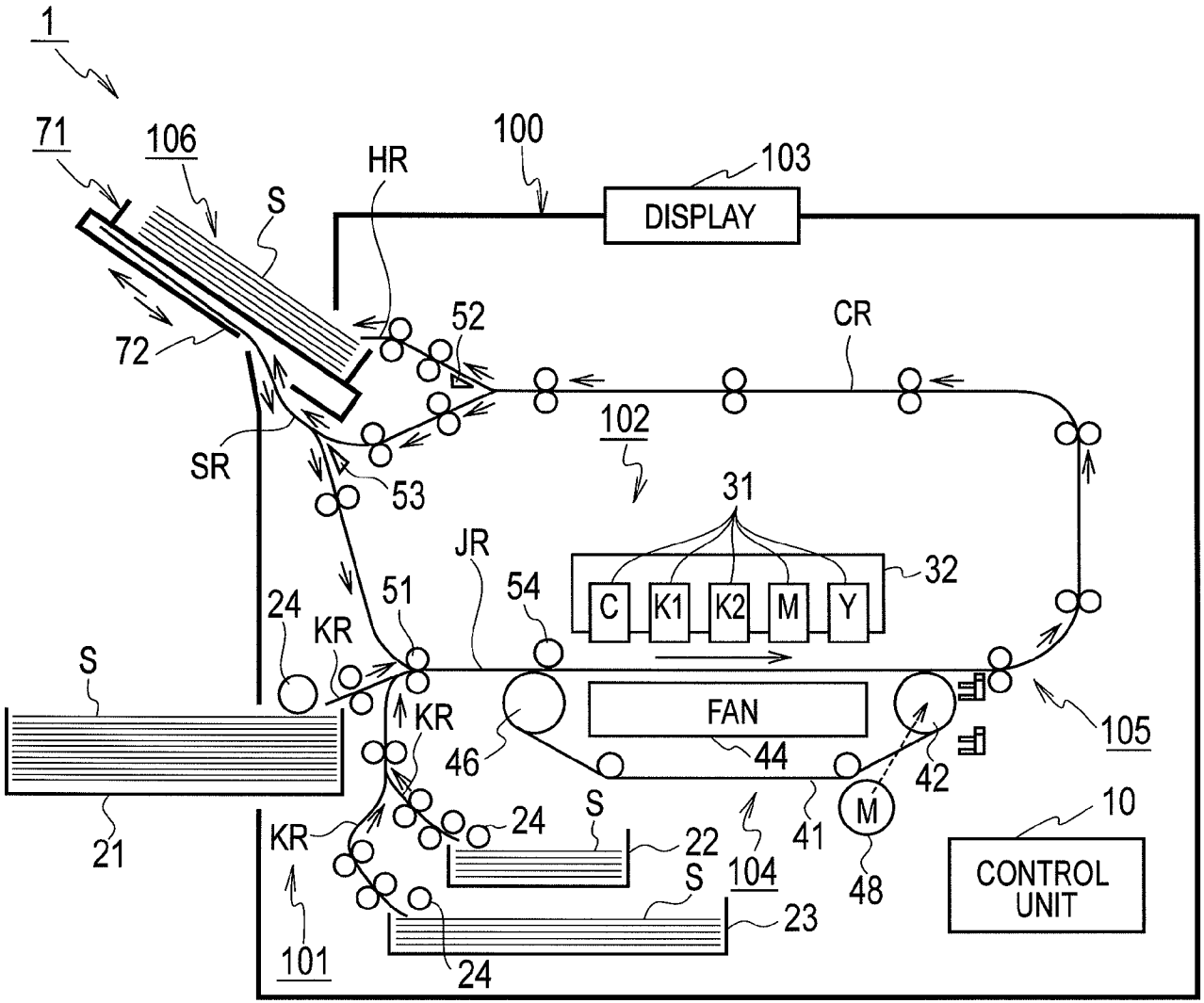
FIG. 1 is an explanatory diagram showing the schematic configuration of a multi-drop, line-type inkjet printer according to a first embodiment of the present invention.

Embodiments of the present invention are described with reference to the drawings. Throughout the drawings, the same or like portions or elements are denoted by the same or like reference numerals, and they are either not described repeatedly or described only briefly.

FIG. 1 is a schematic diagram illustrating the configuration of a line-type inkjet printer according to a first embodiment of the present invention. As shown in FIG. 1, a line-type inkjet printer 1 (called simply an "inkjet printer" 1 below and corresponding to an inkjet recording machine) of this embodiment includes, inside and outside a chassis 100, a control unit 10, a sheet feed unit 101, a printer unit 102, a display 103, a belt platen mechanism unit 104, a recording-sheet circulation conveyance route unit 105, and a sheet discharge unit 106.

The sheet feed unit 101 includes a side sheet feed tray 21 placed at a side surface of the chassis 100 and multiple sheet feed trays 22 and 23 placed at lower left positions in the chassis 100. The side sheet feed tray 21 is a tray for manual sheet feed, and a conveyable recording sheet S of any spec can be set therein. The multiple sheet feed trays 22 and 23, on the other hand, are so-called sheet feed cassettes, and sheets S of different sizes (A4, A3, B4, and B5), different orientations (landscape or portrait), different types (such as, for example, a thick recording sheet of high grammage and a thin recording sheet of low grammage) can be set in the respective sheet feed trays 22 and 23.

The uppermost one of the unprinted recording sheets S stacked on the side sheet feed tray 21 or any of the multiple sheet feed trays 22 and 23 is fed one by one by a sheet feed roller 24, and then the recording sheet S is conveyed by a drive mechanism such as rollers along a sheet feed conveyance route KR. A head portion of the recording sheet S thus fed is guided by paired registration rollers 51 provided on the recording-sheet circulation conveyance route unit 105, and the paired registration rollers 51 adjust the timing for feeding the recording sheet S.

The printer unit 102 is placed and fixed at a position which is approximately the center of the chassis 100, the position being downstream of the sheet feed unit 101 and upstream of the recording-sheet circulation conveyance route unit 105.

In this printer unit 102, multiple line-type inkjet heads 31 (called simply "inkjet heads" 31 below and corresponding to ink heads) for respective colors are arranged. Specifically, the inkjet head 31 for C (cyan), the inkjet heads 31 for K (black), the inkjet head 31 for M (magenta), and the inkjet head 31 for Y (yellow) are arranged in this order from the upstream side to the downstream side. The inkjet heads 31 for the respective colors are attached to a head holder 32, and are arranged at equal intervals in a conveyance direction X of the recording sheet S conveyed by the belt platen mechanism unit 104 (i.e., a sub scanning direction).

In this embodiment, the inkjet printer 1 used as an example is one capable of full-color printing, and therefore the four inkjet heads 31 for the respective four colors (CKMY) are installed. However, if the inkjet printer 1 is one capable of color printing but not full-color printing or one capable of single-color printing, the inkjet heads 31 may be installed as many as the number of colors of ink (one to three) to be used.

The multiple inkjet heads 31 for the respective colors have the same structure. Although not shown in detail in the drawings, each inkjet head 31 has multiple head blocks in each of which multiple nozzles are arranged in a main scanning direction Y (see FIG. 2) which is perpendicular to the plane of FIG. 1. The head blocks are arranged in the main scanning direction Y into two lines adjacent in the sub scanning direction (the same direction as the conveyance direction X) orthogonal to the main scanning direction. The head blocks are arranged in a zigzag manner such that the head blocks of one line partly overlap the head blocks of the adjacent line.

In the inkjet printer 1 of this embodiment, the print resolution in the main scanning direction Y is 300 dpi for C (cyan), M (magenta), and Y (yellow), while the print resolution for B (black) is twice that, i.e., 600 dpi, so that a text in a print image may be sharp on its edges.

For this reason, while a single inkjet head 31 is provided for each of C (cyan), M (magenta), and Y (yellow), two inkjet heads 31 (K1 and K2) are provided for K (black). The nozzles of the inkjet head 31 for K1 are displaced from those of the inkjet head 31 for K2 by half a pitch in the main scanning direction Y.

Each inkjet head 31 prints a print image using multi-drop inkjet method capable of varying the number of drops to be ejected per pixel from a nozzle (not shown) up to five drops. However, for K (black), when a print image is printed with a resolution of 600 dpi, the number of dots ejected from each nozzle is up to three drops so as not to cause a difference in density between K (black) and each of C (cyan), M (magenta), and Y (yellow).

Multivalued data for printing which defines the number of ink drops ID to be ejected per pixel from (each nozzle of) the inkjet head 31 for each color is generated by a CPU 90 (to be described later) of the control unit 10 based on print data in a print job inputted from a client terminal 14.

The belt platen mechanism unit 104 is placed under the multiple inkjet heads 31 and faces the printer unit 102.

In the belt platen mechanism unit 104, a band-like belt platen 41 is looped around each of a driven pulley 42 configured to rotate by being driven by a motor 48 and a follower pulley 46. The belt platen 41 has a number of suction holes so as to convey, while holding, the unprinted recording sheet S fed by the sheet feed unit 101 or the recording sheet S printed on one side and conveyed along a circulation conveyance route JR to be described later.

A suction fan unit 44 configured to generate a negative pressure for sucking the recording sheet S with air onto the belt platen 41 is provided between the driven pulley 42 and the follower pulley 46.

The belt platen (route) 41 has many suction holes. The recording sheet S on the belt platen 41 communicates with the suction fan unit (suction unit) 44 via the suction holes. Then, each suction hole is supplied with a negative pressure by suction power generated by the suction fan unit 44. Thus, the recording sheet S placed on the belt platen 41 receives suction power acting toward the belt platen 41, which power is produced by the negative pressure generated in the suction holes.

Figure 2:
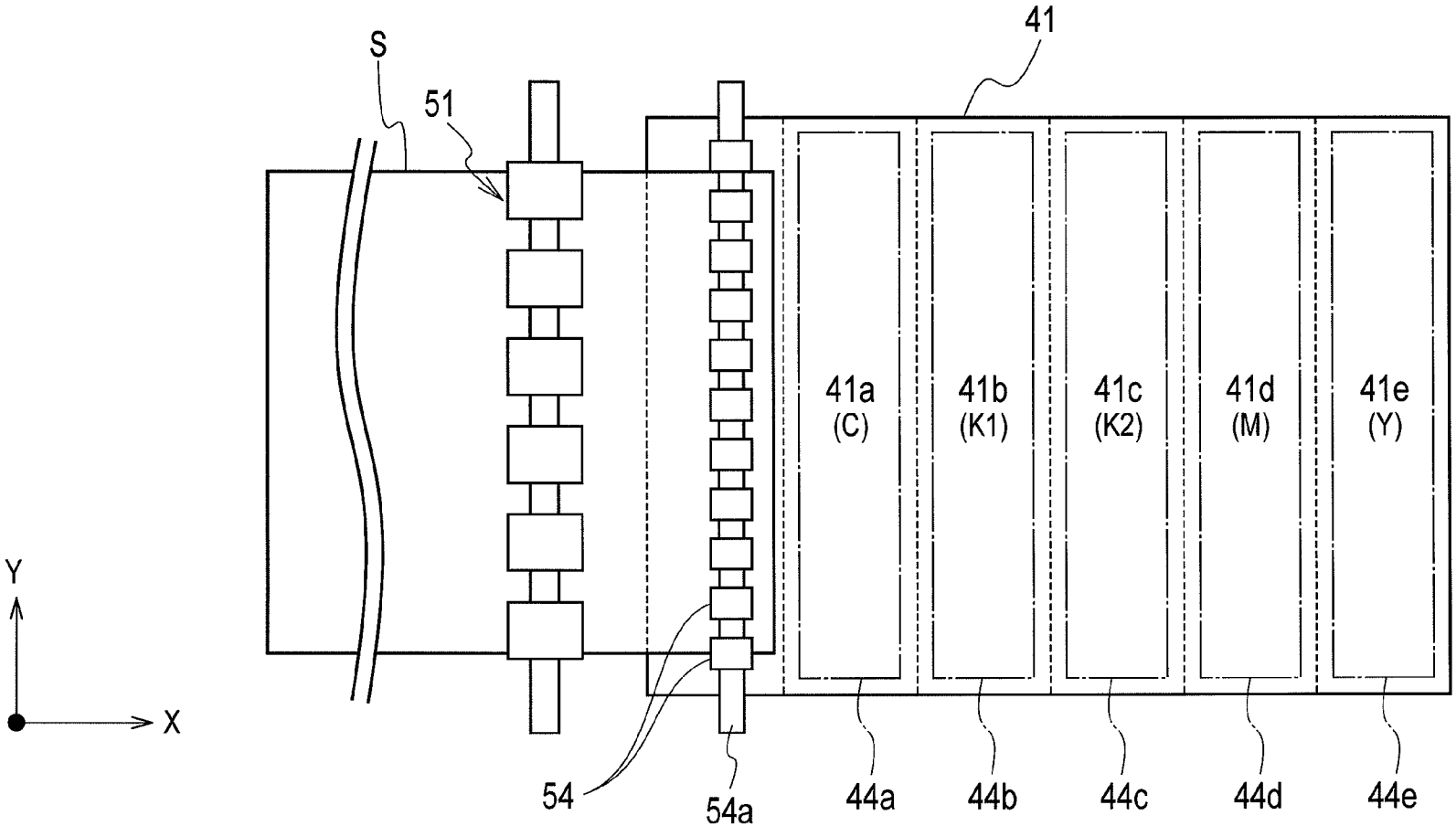
FIG. 2 is an enlarged plan view of a belt platen in FIG. 1.

As shown in an enlarged plan view in FIG. 2, the suction fan unit 44 has five suction fans 44*a* to 44*e* which form arrays extending in a left-right direction in FIG. 2 and are arranged in the conveyance direction X. The suction fans 44*a* to 44*e* correspond to the five inkjet heads 31, respectively.

Specifically, the suction fan 44*a* generates a negative pressure for sucking the recording sheet S at a portion (first area) 41*a* of the belt platen 41 facing the inkjet head 31 for C (cyan). The suction fans 44*b* and 44*c* generate a negative pressure for sucking the recording sheet S at portions (second and third areas) 41*b* and 41*c* of the belt platen 41 facing the inkjet heads 31 for B (black).

Moreover, the suction fan 44*d* generates a negative pressure for sucking the recording sheet Sat a portion (fourth area) 41*d* of the belt platen 41 facing the inkjet head 31 for M (magenta). The suction fan 44*e* generates a negative pressure for sucking the recording sheet S at a portion (fifth area) 41*e* of the belt platen 41 facing the inkjet head 31 for Y (yellow).

In the belt platen mechanism unit 104 shown in FIG. 1, when the recording sheet S is placed on the band-like belt platen 41, the recording sheet S is sucked with air by the suction fans 44*a* to 44*e* through the many suction holes (not shown) formed in the belt platen 41. Then, the belt platen 41 thus having the recording sheet S being fixed thereon rotates to convey the recording sheet S in the conveyance direction X (the sub scanning direction). While the recording sheet S is conveyed, the multiple inkjet heads 31 of the printer unit 102 placed above the belt platen 41 form a full-color print image on the recording sheet S.

The recording-sheet circulation conveyance route unit 105 has the circulation conveyance route JR along which the recording sheet S fed by the sheet feed unit 101 is circulated to pass the printer unit 102 so as to be subjected to one-sided printing or double-sided printing by the printer unit 102. The circulation conveyance route JR branches into a sheet feed conveyance route KR for conveying the unprinted recording sheet S from the side sheet feed tray 21 and a sheet discharge conveyance route HR for conveying the printed sheet S toward a sheet discharge tray 71.

The circulation conveyance route JR is formed annularly by: a regular conveyance route CR along which the recording sheet S having been printed on one side (front side) by the printer unit 102 is conveyed directly in a sheet discharge direction; and a switchback conveyance route SR along which the recording sheet S is switched back in its conveyance direction by first and second conveyance route switching levers 52 and 53 so as to be printed on both sides (the front and back sides) thereof.

The circulation conveyance route JR allows the recording sheet S which is to be printed on both sides to circulate via the printer unit 102. When the recording sheet S is conveyed from the sheet feed conveyance route KR or the switchback conveyance route SR to the circulation conveyance route JR and transferred onto the belt platen 41 after passing between the paired registration rollers 51, the recording sheet S is pressed against the belt platen 41 by sheet pressing rollers 54 so that a curl thereof may be corrected.

As shown in FIG. 2, the multiple sheet pressing rollers 54 are arranged in the main scanning direction Y at equal intervals, and all of them are driven and rotated simultaneously by a common rotary shaft 54*a*. The recording sheet S pressed by the sheet pressing rollers 54 is fed to the printer unit 102, which then forms an image thereon. While passing the printer unit 102, the recording sheet S passes a region where it is sucked to the belt platen 41 by a negative pressure generated by the suction fan unit 44.

The suction fans 44*a* to 44*e* generate a negative pressure for sucking the recording sheet S to the belt platen 41 for their respective different positions in the recording sheet S in the conveyance direction (the sub scanning direction) X. Specifically, at the portion (first area) 41*a* of the belt platen 41 facing the inkjet head 31 for C (cyan), the recording sheet S is sucked to the belt platen 41 by a negative pressure generated by the suction fan 44*a*.

At the portions (second and third areas) 41*b* and 41*c* of the belt platen 41 facing the respective two inkjet heads 31 for K (black) and being adjacent to the first area 41*a*, the recording sheet S is sucked to the belt platen 41 by a negative pressure generated by the suction fans 44*b* and 44*c*.

At the portion (fourth area) 41*d* of the belt platen 41 facing the inkjet head 31 for M (magenta) and being adjacent to the third area 41*c*, the recording sheet S is sucked to the belt platen 41 by a negative pressure generated by the suction fan 44*d*. Further, at the portion (fifth area) 41*e* of the belt platen 41 facing the inkjet head 31 for Y (yellow) and being adjacent to the fourth area 41*d*, the recording sheet S is sucked to the belt platen 41 by a negative pressure generated by the suction fan 44*e*.

Here, assume that the two inkjet heads 31 for K (black) eject ink drops with a resolution of 600 dpi in the main scanning direction Y, which is twice the resolution of the inkjet heads 31 for C (cyan), M (magenta), and Y (yellow), i.e., 300 dpi.

Figure 3A:
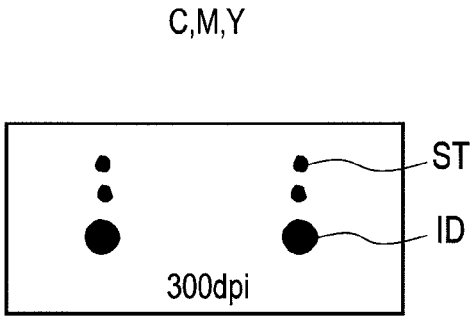
FIGS. 3A and 3B each show how satellite drops are generated when ink drops are ejected by an inkjet head in FIG. 1. Specifically.
Figure 3B:
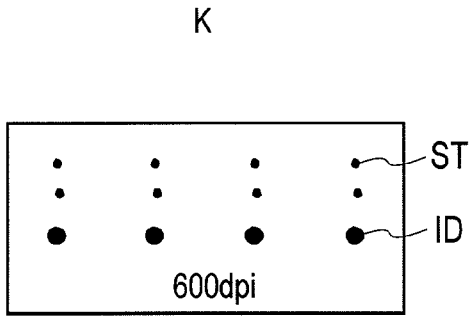

In this case, if each ink drop ID has satellite drops (mist) ST, K (black) ejected with a resolution of 600 dpi suffers the satellite drops ST twice as many as C (cyan), M (magenta), and Y (yellow) ejected with a resolution of 300 dpi, as shown in explanatory diagrams of FIGS. 3A and 3B.

A description is given here of the reason why more satellite drops ST are produced when the print resolution is 600 dpi than when the print resolution is 300 dpi. When a certain image is printed with a print resolution of 600 dpi, the image is formed by pixels (dots) twice as many as those forming the same image printed with a print resolution of 300 dpi.

When ejected from the inkjet head 31, an ink drop ID forming each dot flies with a tail. This tail portion is a factor for producing the satellite drops ST. For this reason, when the number of dots formed is increased with the print resolution raised from 300 dpi to 600 dpi, the number of satellite drops ST produced along with the dots increases as well.

In a multi-drop inkjet head, multiple ink drops ID are successively ejected to the same pixel to form one dot. Thus, each of those drops flies with a tail.

According to what the inventors have achieved from intense study, the tail of a preceding drop is absorbed by the following drop and covered without becoming the satellite drop ST. Hence, when one dot is formed by multiple ink drops ID by the multi-drop method, only the last drop flies with a tail. Thus, even in the case of the multi-drop method, the number of satellite drops ST is the same as the number of dots, and does not increase in proportion to the number of drops ejected to form one dot.

From the above, since the number of pixels for an image of K (black) formed with a print resolution of 600 dpi is twice that of the other three colors (C (cyan), M (magenta), and Y (yellow)) formed with a print resolution of 300 dpi, the number of satellite drops ST produced for K (black) is twice that produced for the other three colors, as well. However, this does not apply when the print rates are different among the colors, and how many times the satellite drops ST are produced differs depending on the difference among the print rates.

When the satellite drops ST are thus produced more, there are more satellite drops ST landing not on the proper landing positions of the ink drops ID but on a white portion of the recording sheet S or around the belt platen 41. Such an increase in the satellite drops ST might contaminate a print image more noticeably to become a factor of degrading the print quality, or might attach to portions of the inkjet printer 1 other than the belt platen 41 to become a factor of damaging the device by contamination.

To avoid such problems, in the inkjet printer 1 of this embodiment, when ink of B (black) is to be ejected using the two inkjet heads 31 and 31 with a resolution of 600 dpi, the power of sucking the recording sheet S to the belt platen 41 by use of a negative pressure is reduced for the second and third areas 41*b* and 41*c* of the belt platen 41 facing these inkjet heads 31 and 31.

Figure 4:
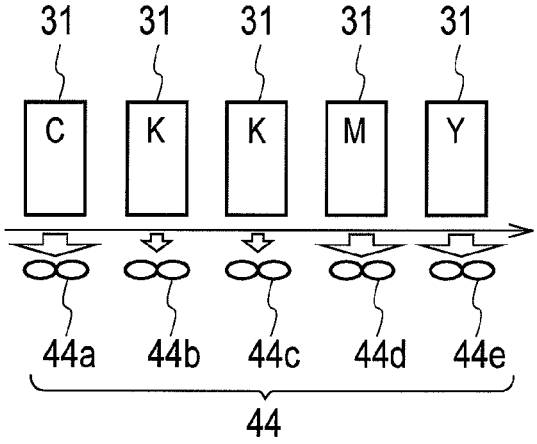
FIG. 4 is an explanatory diagram showing how the amount of negative pressure generated by each of suction fans in FIG. 2 is changed according to a resolution with which the inkjet head facing the suction fan ejects ink drops.

Specifically, as shown in an explanatory diagram of FIG. 4, the suction fans 44*b* and 44*c* corresponding to the second and third areas 41*b* and 41*c* of the belt platen 41 are decreased in their rotating speed so that they may rotate slower than and generate a less amount of negative pressure than the suction fans 44*a*, 44*d*, and 44*e* corresponding to the first, fourth, and fifth areas 41*a*, 41*d*, and 41*e*, respectively (the width of each white arrow in FIG. 4 indicates the amount of negative pressure generated). Such a pattern for driving the suction fans 44*a* to 44*e* may be called a high-resolution pattern below.

The printed recording sheet S being conveyed by the belt platen 41 and having passed under the printer unit 102 is then conveyed to the regular conveyance route CR in the circulation conveyance route JR so as to secure a time for the ink on the recording sheet S to dry. For this reason, the regular conveyance direction CR curves around above the printer unit 102. The printed recording sheet S to be discharged is conveyed from the regular conveyance route CR to the sheet discharge conveyance route HR so that it is directed to the sheet discharge tray 71 of the sheet discharge unit 106.

The printed recording sheet S not to be discharged yet, on the other hand, is conveyed from the regular conveyance route CR to the switchback conveyance route SR in the circulation conveyance route JR. In this event, the conveyance direction of the recording sheet S is changed in the regular conveyance route CR by a first conveyance-route switching lever 52 switching the direction of the preceding portion of the recording sheet S directed to the sheet discharge unit 106 so that the recording sheet S may be instead directed to a recording-sheet guide frame 72 formed at the back of the sheet discharge tray 71 of the sheet discharge unit 106. After the head position of the recording sheet S is reversed in the recording-sheet guide frame 72, the conveyance direction of the recording sheet S is switched and changed by a second conveyance-route switching lever 53. The recording sheet S is then conveyed to the paired registration rollers 51 again and to the printer unit 102 and the platen mechanism unit 104.

The sheet discharge unit 106 includes the sheet discharge tray 71 placed to be oblique with respect to the chassis 100.

The sheet discharge tray 71 has two functions: (1) storing the printed recording sheet S conveyed from the regular conveyance route CR and the sheet discharge conveyance route HR provided in the recording-sheet circulation conveyance route unit 105, and (2) in the recording-sheet guide frame 72 placed at the back of the sheet discharge tray 71, switching back, and thus reversing the head position of, the recording sheet S printed on one side (the front side) so that the recording sheet S may be printed on the back side as well.

Figure 5:
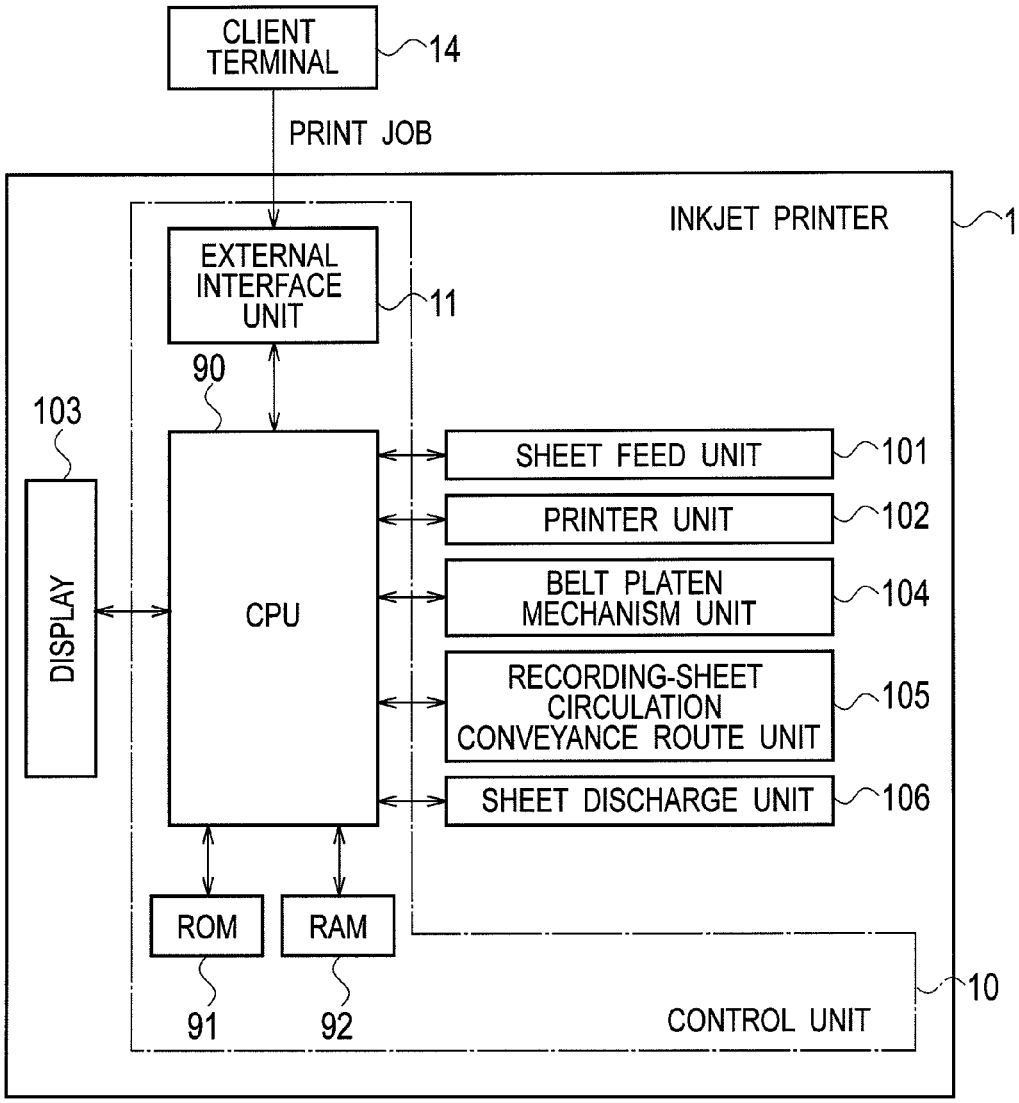
FIG. 5 is a block diagram showing the configuration of a control system of the inkjet printer in FIG. 1.

FIG. 5 is a block diagram showing the electrical configuration of the control unit 10 in FIG. 1. The control unit 10 receives a print job from the client terminal 14 via an external interface unit 11. The print job contains PostScript data and attribute data on an image to be printed. Based on the PostScript data in the print job received, the control unit 10 generates rasterized data on the image to be printed. The inkjet printer 1 prints the image to be printed on the recording sheet S with its printer unit 102 under conditions specified in the attribute data in the print job. The attribute data contains information necessary for determining whether the print resolution for K (black) is to be 300 dpi or 600 dpi (e.g., the information on the type of a recording sheet S used to print).

Based on the PostScript data in the print job inputted by the client terminal 14, the CPU 90 of the control unit 10 generates multivalued data for printing which defines the number of dots formed by the ink drops ID ejected by the inkjet heads 31 of the respective colors of the printer unit 102, the number of dots corresponding to the pixels of the image to be printed.

The CPU 90 of the control unit 10 is connected to the display 103. This display 103 is located at an upper portion of the inkjet printer 1 as shown in FIG. 1, and can be used as an input device and an information output device for various operations of the inkjet printer 1.

The control unit 10 described above includes the CPU 90, as shown in FIG. 5. The CPU 90 controls the operation of each part of the inkjet printer 1 based on set information and programs stored in a RAM 92 and according to the content of an input made via the display 103.

Note that the control unit 10 is provided with a RAM 92 having a frame memory area. In this the frame memory area, the rasterized data on the image to be printed, which is generated by the CPU 90 based on the PostScript data in the print job inputted from the client terminal 14 to the control unit 10, is temporarily stored until it is outputted to the printer unit 102.

Figure 6:
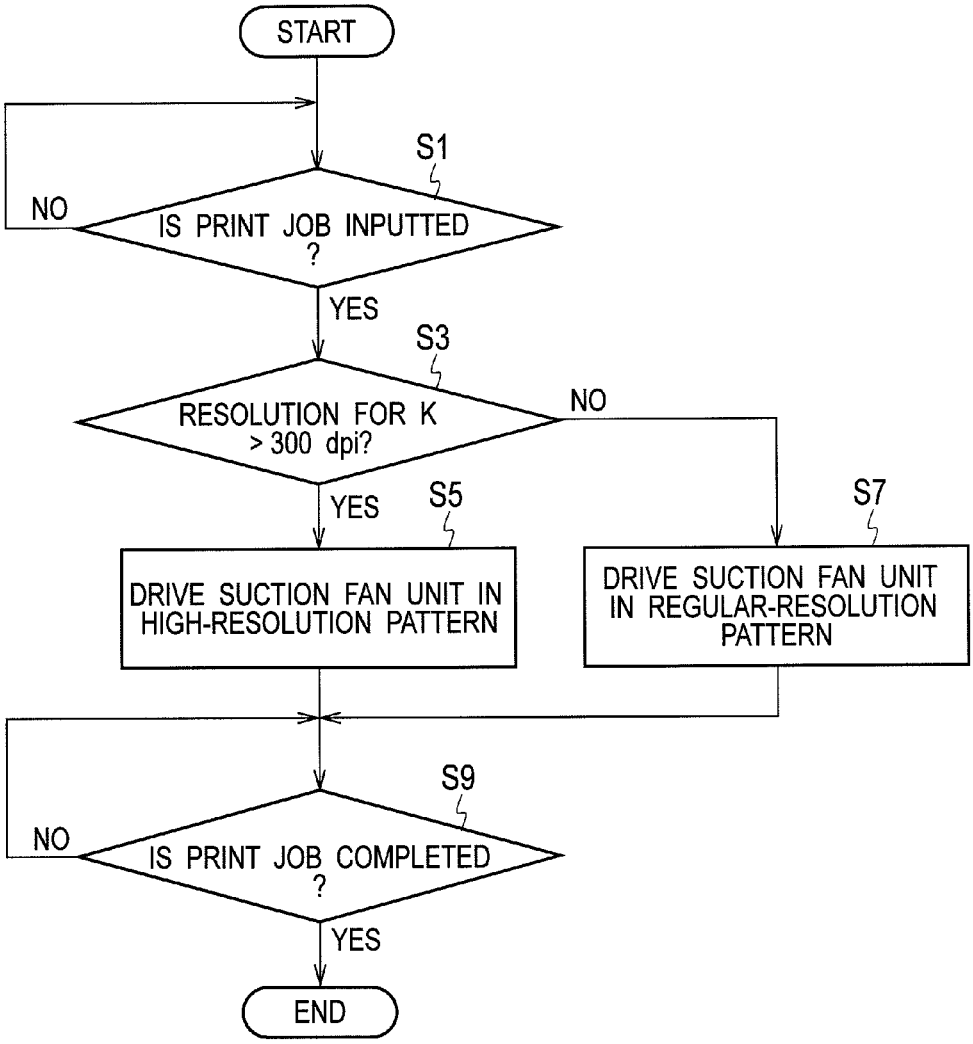
FIG. 6 is a flowchart showing an example of a procedure of processing for controlling driving of a suction fan unit, the processing being performed by a CPU of a control unit based on programs stored in a ROM.

Next, with reference to a flowchart in FIG. 6, a description is given of a procedure of processing for controlling driving of the suction fans 44*a* to 44*e* of the suction fan unit 44, in particular, performed by the CPU 90 of the controlling unit 10 shown in FIG. 5 executing the programs stored in the ROM 91.

As shown in FIG. 6, the CPU 90 first checks whether or not a print job is inputted from the client terminal 14 (Step S1). If no print job is inputted (NO in Step S1), the CPU 90 stands by until a print job is inputted. If a print job is inputted (YES in Step S1), the CPU 90 checks, based on attribute data in the print job inputted, whether or not the print resolution in the main scanning direction Y for K (black) is higher than 300 dpi (Step S3).

If the print resolution is higher than 300 dpi (YES in Step S3), the CPU 90 drives the suction fans 44*a* to 44*e* of the suction fan unit 44 according to the high-resolution pattern described with reference to FIG. 4 (Step S5). After the print job is completed (YES in Step S9), the CPU 90 ends the series of processing, and thereafter repeats the procedure in FIG. 6.

If the print resolution is equal to or lower than 300 dpi (NO in Step S3), the CPU 90 drives the suction fans 44*a* to 44*e* of the suction fan unit 44 according to a regular-resolution pattern in which all the suction fans 44*a* to 44*e* generate the same amount of negative pressure (Step S7). After the print job is completed (YES in Step S9), the CPU 90 ends the series of processing, and thereafter repeats the procedure in FIG. 6.

As is clear from the above description, a predetermined value for the resolution is set to 300 dpi in this embodiment. If it is judged whether the print resolution is 300 dpi or 600 dpi as in this embodiment, the predetermined value may be of course set to a value between 300 dpi and 600 dpi.

In the inkjet printer 1 according to the first embodiment thus configured, when an image is to be printed on the recording sheet S with the same print resolution (300 dpi) for B (black) and for C (cyan), M (magenta), and Y (yellow), the suction fans 44*a* to 44*e* for the first to fifth areas 41*a* to 41*e* of the belt platen 41 facing the inkjet heads 31 of the respective colors are driven to generate the same amount of negative pressure.

On the other hand, when an image is be printed on the recording sheet S with a high print resolution of 600 dpi only for K (black), the suction fans 44*b* and 44*c* for the second and third areas 41*b* and 41*c* of the belt platen 41 facing the two inkjet heads 31 and 31 for K (black) are driven to generate a less amount of negative pressure than the other suction fans 44*a*, 44*d*, and 44*e* do.

In this case, since the resolution for K (black) is twice the resolution for C (cyan), M (magenta), and Y (yellow), the ink drops ID for B (black) are ejected twice as many as those for the other colors. For this reason, the number of satellite drops ST doubles.

However, since a less amount of negative pressure is generated by the suction fans 44*b* and 44*c* corresponding to the inkjet heads 31 for K (black), a range in which the satellite drops ST flies along with the air sucking the recording sheet S to the belt platen 41 is smaller for B (black) than for C (cyan), M (magenta), and Y (yellow).

When the flying range of the satellite drops ST is small, even if the number of satellite drops ST landing on, for example, an inter-dot space on the recording sheet S increases with the increase in the resolution, the satellite drops ST land on a portion near the dot and are therefore less noticeable. This prevents degradation in the quality of a printed image and progress of contamination damage of the device.

In this embodiment, to support the print resolution of 600 dpi, two inkjet heads 31 are provided for K (black) and are arranged with their nozzles displaced from each other by half a pitch in the main scanning direction Y. However, the print resolution of 600 dpi for B (black) may be supported by a single inkjet head 31 having twice as many nozzles arranged at half a pitch.

Figure 7:
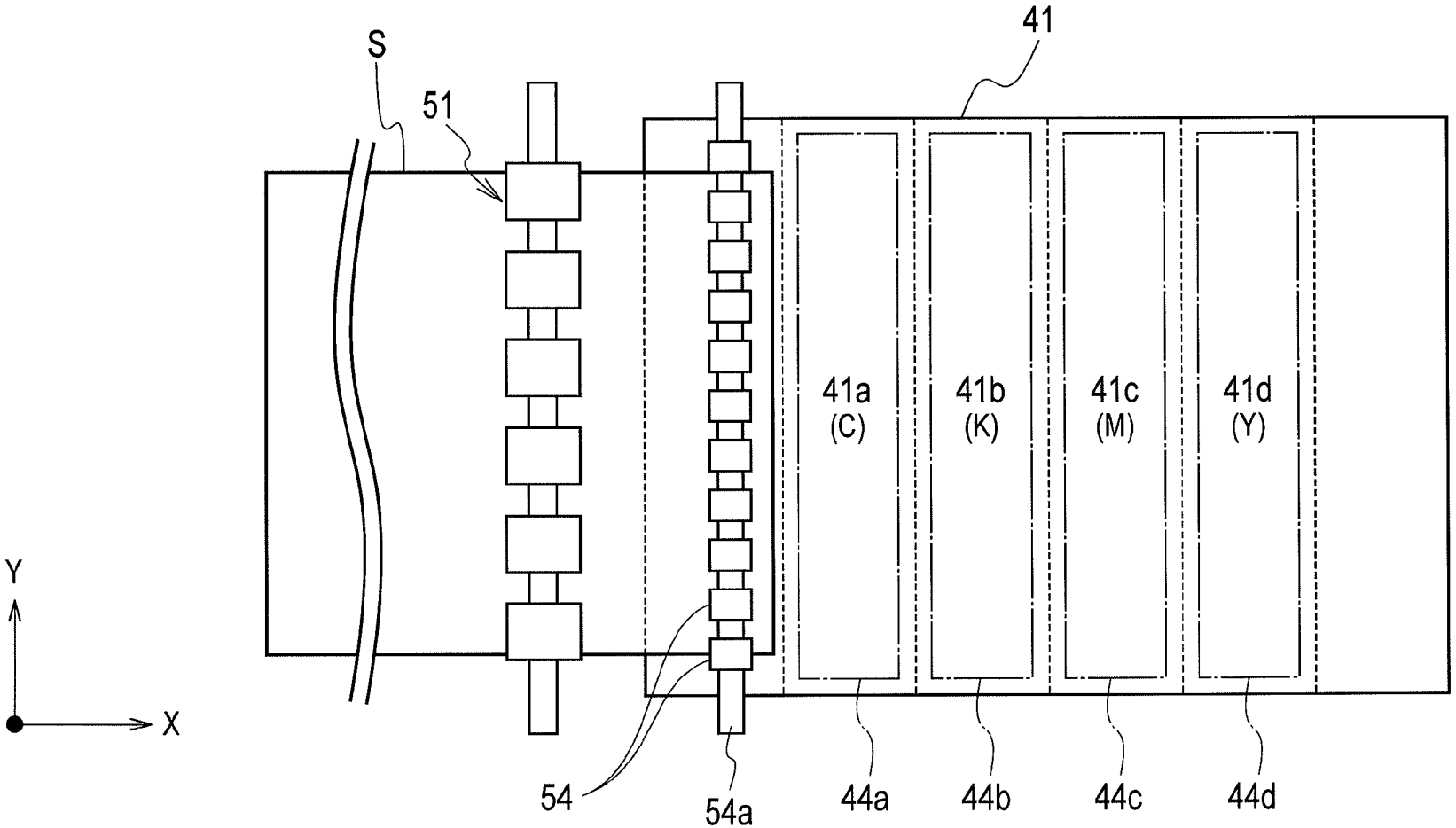
FIG. 7 is an enlarged plan view of a belt platen of a multi-drop, line-type inkjet printer according to a second embodiment of the present invention, in which a single inkjet head capable of printing with a resolution of 600 dpi is provided for K (black).

FIG. 7 is an enlarged plan view showing such an inkjet printer of a second embodiment. As shown in FIG. 7, in the above case, the suction fan unit 44 placed at the back of the belt platen 41 has four arrays of suction fans 44*a* to 44*d* arranged in the conveyance direction X extending in the left-right direction in FIG. 7. The suction fans 44*a* to 44*d* correspond to the inkjet heads 31 for C, K, M, and Y, respectively.

Specifically, the suction fan 44*a* generates a negative pressure for sucking the recording sheet S at a portion (first area) 41*a* of the belt platen 41 facing the inkjet head 31 for C (cyan). The suction fan 44*b* generates a negative pressure for sucking the recording sheet S at a portion (second area) 41*b* of the belt platen 41 facing the inkjet head 31 for B (black).

Moreover, the suction fan 44*c* generates a negative pressure for sucking the recording sheet S at a portion (third area) 41*c* of the belt platen 41 facing the inkjet head 31 for M (magenta). The suction fan 44*d* generates a negative pressure for sucking the recording sheet S at a portion (fourth area) 41*d* of the belt platen 41 facing the inkjet head 31 for Y (yellow).

Figure 8:
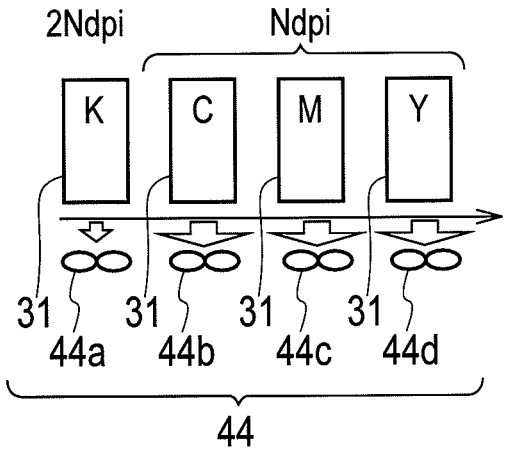
FIG. 8 is an explanatory diagram showing how the amount of negative pressure generated by each of suction fans in FIG. 7 is changed according to a resolution with which the inkjet head facing the suction fan ejects ink drops.

As shown in the explanatory diagram of FIG. 8, the suction fan 44*b* corresponding to the second area 41*b* of the belt platen 41 is decreased in its rotating speed so that it may rotate slower than and generate a less amount of negative pressure than the suction fans 44*a*, 44*c*, and 44*d* corresponding to the first, third, and fourth areas 41*a*, 41*c*, and 41*d*, respectively (the width of each white arrow in FIG. 8 indicates the amount of negative pressure generated).

In this embodiment, a pattern for driving the suction fans 44*a* to 44*d* as shown in FIG. 8 is the high-resolution pattern. Further, driving the suction fans 44*a* to 44*d* in such a manner that all of them may generate the same amount of negative pressure is the regular-resolution pattern.

The procedure of processing for controlling driving of the suction fans 44*a* to 44*d* of the suction fan unit 44, in particular, performed by the CPU 90 of the inkjet printer 1 of this embodiment is the same as that described with the flowchart in FIG. 6.

Also in the inkjet printer 1 of the second embodiment thus configured, even if the number of satellite drops ST increases with the increase in the resolution, the satellite drops ST land on a portion near the dot and are therefore less noticeable. This prevents degradation in the quality of a printed image and progress of contamination damage of the device.

In the first and second embodiments described above, the total amount of negative pressure generated by all the suction fans 44*a* to 44*e* (or the suction fans 44*a* to 44*d*) when they are driven with the high-resolution pattern may be the same as that generated when they are driven with the regular-resolution pattern. In this case, according to the level by which the suction fans 44*b* and 44*c* (or the suction fan 44*b*) are (or is) decreased in its rotating speed, the other suction fans 44*a*, 44*d*, and 44*e* (or the suction fans 44*a*, 44*c*, and 44*d*) are increased in their rotating speed.

Thereby, even in a case where, in order to suppress flight of the satellite drops ST, the power of sucking the recording sheet S to the second and third areas 41*b* and 41*c* (or the second area 41*b*) of the belt platen 41 is reduced by decreasing the rotating speed of the suction fans 44*b* and 44*c* (or the suction fan 44*b*) and thus lowering the amount of negative pressure generated by them (or it), the amount of negative pressure for sucking the recording sheet S is kept constant for the overall belt platen 41 (or the first to fifth areas 41*a* to 41*e*).

For this reason, while maintaining the capability of the entire belt platen 41 for sucking the recording sheet S, the satellite drops ST, which are produced more when the ink drops ID are ejected from the inkjet head (s) 31 for K (black) to form an image with a print resolution of 600 dpi, are prevented from flying over a large area. This prevents degradation in the quality of a printed image and progress of contamination damage of the device.

In the first and second embodiments described above, the print resolution in the main scanning direction is 600 dpi. The present invention is also applicable when the print resolution in the conveyance direction (sub scanning direction) X is 600 dpi.

Figure 9:
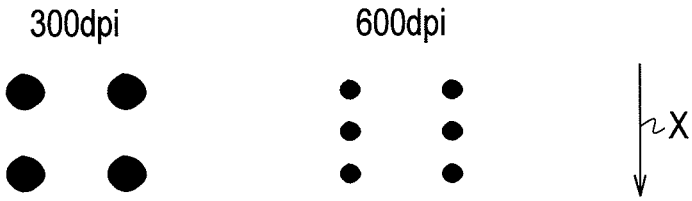
FIG. 9 is an explanatory diagram showing how ink drops land in cases where they are ejected by the inkjet head in FIG. 1 with a resolution of 300 dpi and with a resolution of 600 dpi, respectively.

When, for example, the print resolution for K (black) is 600 dpi in the conveyance direction (sub scanning direction) X, the cycle at which the inkjet head 31 for K ejects ink drops from its nozzles is shortened by half. Thereby, as shown in the explanatory diagram in FIG. 9, twice as many ink drops ID land on the recording sheet S at half a pitch in the conveyance direction (sub scanning direction) X. Since the satellite drops ST are produced for each ink drop ID, the amount of satellite drops ST produced when the ink drops ID are ejected with a print resolution of 600 dpi in the conveyance direction (sub scanning direction) X is larger than that produced when the ink drops ID are ejected with a print resolution of 300 dpi.

The amount of negative pressure to be generated by the suction fan for the area in the belt platen 41 facing the inkjet head 31 for K (black), the print resolution for which is 600 dpi, is reduced to be lower than that generated by the suction fans for the areas facing the inkjet heads 31 for C (cyan), M (magenta), and Y (yellow), the print resolution for which is 300 dpi.

The procedure of processing for controlling driving of the suction fans 44*a* to 44*d* of the suction fan unit 44, in particular, performed by the CPU 90 when printing an image with a 600-dpi print resolution in the conveyance direction (sub scanning direction) X is almost the same as that described with the flowchart in FIG. 6. The only thing different is that, in Step S3, the CPU 90 checks, based on attribute data in the print job inputted, whether the print resolution in the conveyance direction (sub scanning direction) X (instead of in the main scanning direction Y) for K (black) is higher than 300 dpi or not.

In a case where the print resolution for K (black) is 600 dpi in both the main scanning direction Y and the conveyance direction (sub scanning direction) X, the CPU 90 checks, in Step S3 in the flowchart in FIG. 6, whether or not the print resolution for K (black) defined in the attribute data in the print job is higher than 300 dpi in at least one of the main scanning direction Y and the conveyance direction (sub scanning direction) X.

Then, if the print resolution for K (black) is higher than 300 dpi in at least one of those directions, the suction fans 44*a* to 44*e* (or 44*a* to 44*d*) are controlled in their driving according to a driving pattern, like the ones described in the first and second embodiments.

In this way, if the print resolution for K (black) is 600 dpi in both of the main scanning direction Y and the conveyance direction (sub scanning direction) X, a double number of ink drops are ejected in both of the directions. For this reason, the number of satellite drops ST produced for K (black) is four times as many as those produced for C (cyan), M (magenta), and Y (yellow), the print resolution for which is 300 dpi in both the main scanning direction Y and the conveyance direction (sub scanning direction) X.

Hence, by decreasing the amount of negative pressure generated by the suction fans 44*b* and 44*c* (or the suction fan 44*b*) corresponding to the inkjet head(s) 31 for K (black) to an amount lower than that generated by the suction fans 44*a*, 44*d*, and 44*e* (or the suction fans 44*a*, 44*c*, and 44*d*) corresponding to the inkjet heads 31 for C (cyan), M (magenta), and Y (yellow), it is possible to more remarkably prevent degradation in the quality of a printed image and progress of contamination damage of the device.

Further, in the embodiments described above, the print resolution in the main scanning direction Y and/or the conveyance direction (sub scanning direction) X is 600 dpi only for ink of K (black). However, the present invention is also applicable when the print resolution for some or all of C (cyan), K (black), M (magenta), and Y (yellow) is raised to 600 dpi in the main scanning direction Y and/or the conveyance direction (sub scanning direction) X.

In this case, the rotating speeds of the suction fans 44*a* to 44*e* (or 44*a* to 44*d*) are controlled by the CPU 90 so as to reduce the amount of negative pressure generated by one or ones of the suction fans 44*a* to 44*e* (or 44*a* to 44*d*) which correspond to the inkjet head(s) 31 of the color to be printed with a resolution of 600 dpi.

In this way, when the print resolution is different from one color of ink to another, the amount of negative pressure to be generated is controlled for each of the suction fans 44*a* to 44*e* (or 44*a* to 44*d*) corresponding to the inkjet heads of the respective colors of ink. Further, when the print resolution is the same for all the colors of ink but is different for each image to be printed (for each print job), the amount of negative pressure to be generated by the suction fans 44*a* to 44*e* (or 44*a* to 44*d*) may be controlled for each image to be printed (for each print job) in the same way.

A method for reducing the power of sucking the recording sheet S to the first to fifth areas 41*a* to 41*e* (or the first to fourth areas 41*a* to 41*d*) of the belt platen 41 is not limited to the method of decreasing the amount of negative pressure generated by (i.e., decreasing the rotating speed of) the suction fans 44*a* to 44*e* (or 44*a* to 44*d*) corresponding to the respective areas 41*a* to 41*e* (or 41*a* to 41*d*), but may be any other method.

Figure 10A:
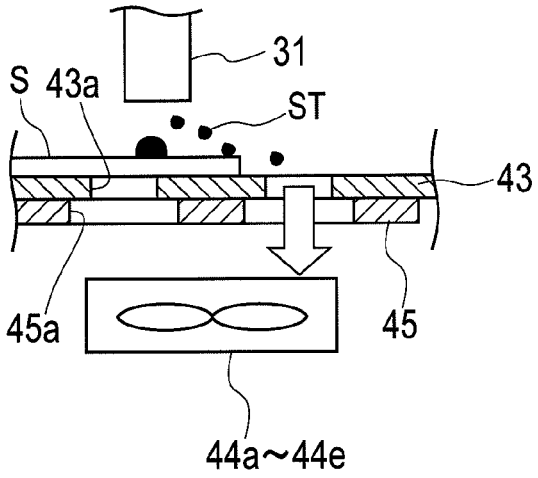
FIGS. 10A to 10C are each an enlarged sectional view schematically showing a relation between the size of suction holes of a belt platen and power of sucking a recording medium, FIG. 10A showing a regular state, FIG. 10B showing a state where the suction holes are partly closed by using a slide plate, FIG. 10C showing a state where some of the suction holes are closed to thin out the suction holes.

For example, as schematically shown in an enlarged sectional view in FIG. 10A, suppose a case where the belt platen 41 has a belt 43 and a platen 45 at the back of the belt 43 which are provided with suction holes 43*a* and suction holes 45*a*, respectively, through which suction air generated by the negative pressure generated by the suction fans 44*a* to 44*e* (or 44*a* to 44*d*) passes (the diameter of each suction hole 43*a*<the diameter of each suction hole 45*a*). In this case, to reduce the power of sucking the recording sheet S to the platen 41, a mechanism for adjusting the size of each suction hole 45*a* of the platen 45 only has to be provided.

Figure 10B:
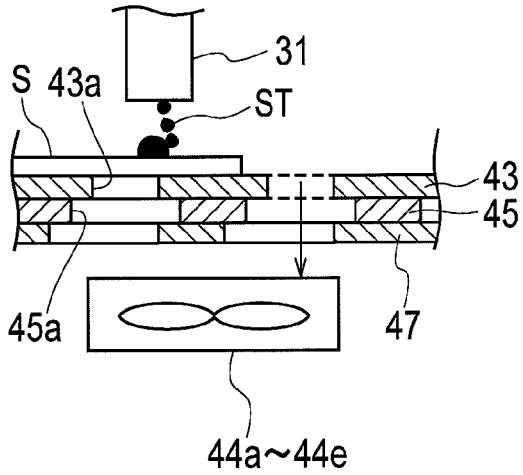

Specifically, the power of sucking the recording sheet S may be changed by a method in which the amount of suction air is reduced by moving a slide plate 47 placed at the back of the platen 45 along the platen 45 so that the suction holes 45*a* are partly closed to be substantially reduced in size, as schematically shown in an enlarged sectional view in FIG. 10B.

Figure 10C:
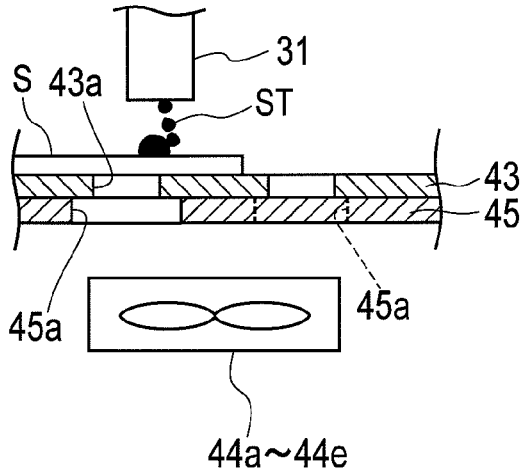

Alternatively, the power of sucking the recording sheet S may be changed by a method in which the suction holes 45*a* through which the suction air passes are thinned out by configuring the suction holes 45*a* of the platen 45 to be individually openable and closeable and by closing appropriate ones of the suction holes 45*a* to reduce the power of sucking the recording sheet S to the belt platen 41, as schematically shown in an enlarged sectional view of FIG. 10C. Note that FIG. 10C shows a state where the appropriate ones of the suction holes 45*a* are closed.

Although the above embodiments use a line-type inkjet printer as an example, the present invention is also applicable to a so-called multipath (serial-type) inkjet printer configured to form an image on a recording sheet being conveyed while being sucked to a conveyer belt (belt platen).

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet recording machine comprising:

a conveyance route configured to convey a recording medium in a conveyance direction;

a suction unit configured to generate a negative pressure for sucking the recording medium to the conveyance route;

an ink head having nozzles configured to eject ink drops; and a control unit configured to form a print image on the recording medium by ejecting ink drops from the nozzles of the ink head to the recording medium being conveyed on the conveyance route and sucked to the conveyance route by the negative pressure generated by the suction unit, wherein:

the control unit is configured to control a level of suction power of sucking the recording medium to the conveyance route by the negative pressure in accordance with a level of a resolution of the print image in at least one of a main scanning direction orthogonal to the conveyance direction or a sub scanning direction along the conveyance direction, the ink head is provided in a plurality for respective colors of ink, the ink head of at least certain one of the colors of ink is capable of ejecting ink drops with a higher resolution than the ink head of the other color, and the control unit is configured to drive the ink head of the certain color of ink to eject ink drops with the higher resolution than the ink head of the other color, with the suction power for a first portion of the conveyance route facing the ink head of the certain color of ink more reduced than the suction power for a second portion of the conveyance route facing the ink head of the other color.

2. The inkjet recording machine according to claim 1, wherein the control unit is configured to reduce the suction power for the first portion to be lower than the suction power for the second portion by reducing an amount of the negative pressure for the first portion to be lower than an amount of the negative pressure for the second portion with a total amount of the negative pressure generated by the suction unit for an entire of the conveyance route being constant.

3. An inkjet recording machine comprising:

a conveyance route configured to convey a recording medium in a conveyance direction;

a suction unit configured to generate a negative pressure for sucking the recording medium to the conveyance route;

an ink head having nozzles configured to eject ink drops; and a control unit configured to form a print image on the recording medium by ejecting ink drops from the nozzles of the ink head to the recording medium being conveyed on the conveyance route and sucked to the conveyance route by the negative pressure generated by the suction unit, wherein the control unit is configured to control a level of suction power of sucking the recording medium to the conveyance route by the negative pressure in accordance with a level of a resolution of the print image in at least one of a main scanning direction orthogonal to the conveyance direction or a sub scanning direction along the conveyance direction, and wherein the control unit is configured to print the print image with a resolution above a predetermined value with an amount of the negative pressure generated by the suction unit more reduced than in printing the print image with a resolution at or below the predetermined value.

* * * * *